United States Patent [19]

Wyatt et al.

[11] Patent Number: 4,554,543

[45] Date of Patent: Nov. 19, 1985

[54] GLIDE SLOPE INDICATOR SYSTEM

[75] Inventors: Ivan S. Wyatt, Gilbert, Ariz.; Harry L. Task, Dayton, Ohio

[73] Assignee: The United States of America as represented by the Secretary of the Air Force, Washington, D.C.

[21] Appl. No.: 473,392

[22] Filed: Mar. 8, 1983

[51] Int. Cl.[4] ..... G08C 5/00

[52] U.S. Cl. ..... 340/948; 73/178 T; 244/183; 340/951; 340/953; 340/972

[58] Field of Search ..... 340/945, 947, 948, 951, 340/952, 953, 954, 956, 972, 981; 73/178 T; 244/175, 183; 350/433; 250/350; 455/611, 617

[56] References Cited

U.S. PATENT DOCUMENTS

| | | | |
|---|---|---|---|
| 2,489,222 | 11/1949 | Herbold | 33/46 |
| 2,597,321 | 5/1952 | Hergenrother | 177/352 |
| 2,975,284 | 3/1961 | Osborne | 340/948 |
| 3,529,283 | 9/1970 | Emerson | 340/947 |
| 3,671,963 | 6/1972 | Assouline | 340/948 |
| 3,972,125 | 8/1976 | Collins | 340/951 |
| 4,183,078 | 1/1980 | Kidd | 340/951 |
| 4,196,346 | 4/1980 | McElhannon | 340/951 |
| 4,209,767 | 6/1980 | Flanders | 340/947 |
| 4,259,658 | 3/1981 | Basov | 340/953 |
| 4,277,170 | 7/1981 | Miles | 340/981 |
| 4,385,354 | 5/1983 | Hornfield | 340/952 |

*Primary Examiner*—John W. Caldwell, Sr.
*Assistant Examiner*—Michael F. Heim
*Attorney, Agent, or Firm*—Donald J. Singer; Bernard E. Franz

[57] ABSTRACT

A glide slope indicator system in which light from an incoming aircraft's landing light is shaped by spherical/cylindrical lens combination into a line image which strikes a linear photodiode array. By determining which photodiode in the array the center of the line image strikes, the glide slope angle can be determined. An appropriate signal is communicated to the pilot via a pair of indicator lights mounted on the runway depending upon whether the aircraft is above, below or on the desired glide slope angle.

6 Claims, 6 Drawing Figures

GLIDE SLOPE INDICATOR SYSTEM

RIGHTS OF THE GOVERNMENT

The invention described herein may be manufactured and used by or for the Government of the United States for all governmental purposes without the payment of any royalty.

BACKGROUND OF THE INVENTION

This invention relates generally to apparatus for aiding the landing of aircraft, and more particularly to glide slope control apparatus for use with a visual approach to the runway.

The capability of using small and limited landing areas is required for numerous operations of military aircraft, including short take-off and landing (STOL) transport planes as well as fighter planes. Landing under such conditions is possible only if the final approach takes place under almost optimal conditions of the mechanics of flight, i.e., if the glide angle, the angle of pitch and the speed are so adjusted that flattening-out and rolling-out after touchdown is effected within the shortest possible distance.

With modern military aircraft, the estimating capability of the pilot is frequently inadequate to safely land the aircraft thereby necessitating aiding devices aboard the plane. One such device is a glide slope control. The glide slope control provides information to the pilot concerning the aircraft's position relative to an optimum glidepath that will assure a safe descending approach angle and a proper touchdown on the runway.

Often the requirement for STOL aircraft is dictated by the airfield being located relatively close to enemy territory or by the airfield being located in a remote area where only austere conditions are present. Oftentimes, too, a requirement will exist for special operational aircrews to perform night landings at airfields under less then optimal conditions. These night operations sometimes require radio and electromagnetic silence and place an excessive burden on the visual capability of the pilot. Under such circumstances, a non-electromagnetic technique is sorely needed to provide precise glide slope performance of the aircraft for both cockpit and ground monitoring during approach to landing. In addition, such a technique is needed to provide substantive training of personnel and to provide suitable operating conditions for research and development of future products.

Prior work in the area of optical glide slope techniques include U.S. Pat. No. 2,597,321 to R. C. Hergenrother which discloses a light ray, projected from ground sources, used to determine the aircraft approach angle for gliding the plane into a proper landing. Also, U.S. Pat. No. 2,489,222 to Herbold teaches a glide slope indicator system which uses a ground based light source and receptive photodiodes positioned on the aircraft. While these patents are suitable for their intended purpose, neither patent exhibits the simplicity and inexpensiveness of the present invention nor does either patent provide the degree of precision desired for nighttime and other critical landing operations.

SUMMARY OF THE INVENTION

It is therefore an object of the invention to provide a non-electromagnetic aircraft glide slope control apparatus which can be employed for nighttime and other adverse landing operations.

Another object of the invention is to provide an inexpensive and highly versatile glide slope control apparatus which utilizes an aircraft's standard landing lights as a light source from which to measure glide slope angle.

Yet another object of the invention is to provide a glide slope control apparatus which relieves the pilot of making subjective estimates of the glide angle during landing approach and which, at the same time, enables the pilot to control his descending course without having to take his eyes off the landing field.

According to the invention, a spherical/cylindrical objective lens combination shapes a light source emitted from the front of the aircraft into a line image which strikes a linear photodiode array. By determining which of the photodiodes the center of the line image strikes, the glide slope angle can be determined. An appropriate signal is communicated to the pilot via lights mounted on the runway indicating whether the aircraft is above, below, or on the desired glide slope angle.

DETAILED DESCRIPTION OF THE INVENTION

Figure 1:
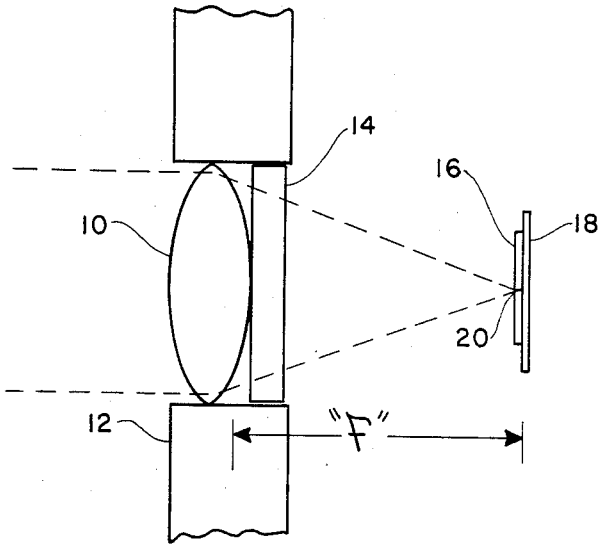
FIG. 1 is a side view of the preferred embodiment of the invention showing a spherical/cylindrical lens combination with a linear photodiode array located at the back focal plane.
Figure 2:
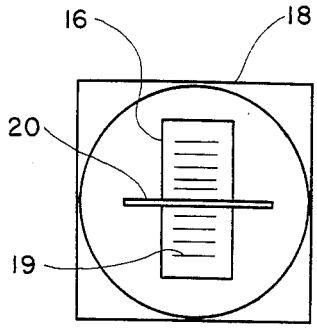
FIG. 2 shows the rectangular shape of the photodiode array with the line image superimposed on the array.

Referring to FIG. 1, the physical layout of the optical portion of the present invention is shown. A spherical objective lens 10 of the converging type is mounted in a holding device 12 such that its optical axis is adjusted to form a desired glide slope reference angle with the ground plane. Immediately adjacent to this converging lens 10 is a cylindrical lens 14 oriented such that the longitudinal axis of the cylinder is perpendicular to the lens' optical axis and also perpendicular to the reference angle. As shown in both FIG. 1 and FIG. 2, a photodiode array 16 is secured to a mounting surface 18 and is placed at the back focal plane of objective lens 10. The photodiode array preferably comprises a plurality of charge coupled device (CCD) elements 19 arranged in a vertical column. Each photodiode element has separate electrical connections rendering each element electrically independent of the other elements. When an aircraft is on final approach and in the field of view of the device, the spherical/cylindrical lens combination focuses and shapes the image of a light source emitted from the front of the aircraft into a line 20. Standard landing lights fitted on the aircraft provide an ideal light source for this purpose. It is understood, however, that other light sources specially fitted on the aircraft may also be used. The line is perpendicular to the vertical column of elements and falls on at least one of the elements. As the aircraft moves up and down in the field of view of the device, the line image 20 moves down and up, respectively, on the photodiode array. With the device leveled and a reference established for zero degrees (with respect to a ground plane) on the photodiode array, the position of the line image then becomes a measure of the glide slope angle.

Figure 3:
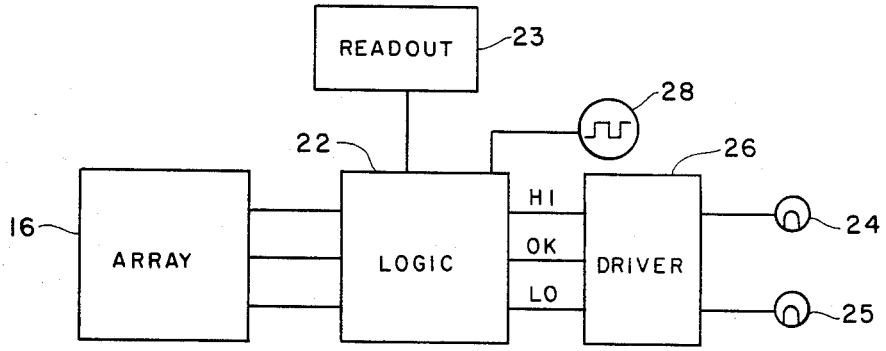
FIG. 3 is a block diagram of a portion of the preferred embodiment of the invention.

Each element of the photodiode array is energized independently of the other elements when the line image falls on that particular element. Each element can then be referenced to a specific glide angle with the glide angle of the incoming aircraft communicated to both the pilot of the incoming aircraft and ground personnel. A partial block diagram of the preferred embodiment is shown in FIG. 3, in which the photodiode array 16 is connected to a logic circuit network 22 which has three output lines, "hi", "lo", and "ok", which are coupled to two pilot indicator lamps 24 and 25 through an interface/driver circuit 26. The "ok" line passes a signal to the interface/driver circuit when the logic network indicates that the glide slope angle is acceptable for a safe landing. The "lo" line passes a signal to the interface/driver circuit when the logic network indicates a lower glide slope angle than is acceptable, while the "hi" line passes a signal which indicates a higher glide slope angle than is acceptable. The logic network scans the photodiode array and provides the predetermined switching sequence to control the indicator lamps while the interface/driver circuit provides the power necessary to drive the indicator lamps in response to the control signals from the logic network. An oscillator 28 is also fed as an input to the logic network thereby providing the capability of "flashing" the indicator lamps.

Figure 4:
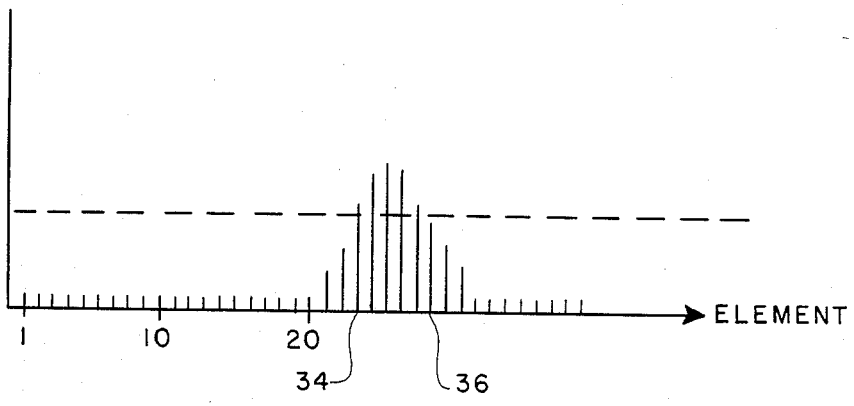
FIG. 4 is a graphical representation of the video output for each element of the photodiode array.

The scanning function of the logic network comprises scanning each element within the photodiode array and determining if the response of each is above or below a predetermined threshold. With each scan, the array produces from the illuminated photodiodes, an output made up of individual pulses, or "pixels" having different discrete levels. FIG. 4 shows the pixel signal from each element in the CCD array with the line image causing a significantly higher pixel output level from the elements that the line image strikes, The x-axis refers to each actual CCD array element. Parallel to and just above the x-axis is a horizontal line 32 indicating the threshold at which an individual element produces a sufficiently strong signal to indicate that the line has struck this particular element. The center of the line image is the midpoint of the pixel levels above the threshold. One way to determine this midpoint is to count the number of pulses from the start of the array scan up to the first pulse 34 above the threshold, and then to count only alternate pulses until a point 36 is reached where the pixel output falls below the threshold. The total count then indicates the number of elements from the start of the scan to the midpoint between pulses 34 and 36. In this manner, the problem of the line image being wider than is desirable and striking many CCD elements, is solved. By knowing which elements are referenced to an acceptable range of glide slope angle, the logic network can pass the appropriate signals to the interface/driver. The construction of the logic network in terms of locating the midpoint of the line image can be accomplished according to the guidelines published in U.S. Pat. No. 4,309,106 to Smith and U.S. Pat. No. 4,221,973 to Nosler.

It should be noted that if the spherical/cylindrical lens combination produces an extremely sharp line image, the counting technique employed above is unnecessary. With such a line image, the line would strike a very discernable array element. By establishing a reference, the particular array elements which indicate an acceptable or unacceptable glide slope angle are easily identified. With this technique, the individual array element could be wired directly and the scanning function would be unnecessary. Also, the number of elements could be expanded, both by rows and columns, to insure greater accuracy.

Figure 5:
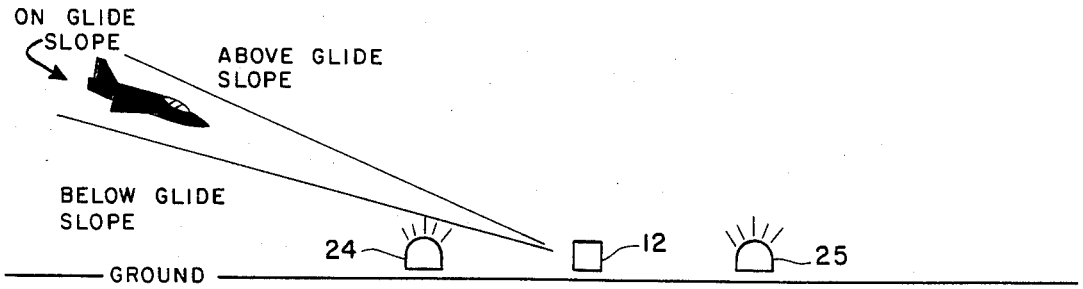
FIG. 5 is a side view of the preferred embodiment of the invention showing its operation on an airfield.

There are numerous possible layouts for the pilot indicator lamps. The prefered embodiment is shown in FIG. 5 and consists of the two pilot indicator lamps 24 and 25 placed 250 feet apart parallel to the runway center line with the holding device 12 containing the spherical/cylindrical lens combination and the photodiode array located midway between the two lamps. The photodiode array senses the line image created by an incoming aircraft's light source, determines the aircraft's position with respect to the desired glide slope angle, and the logic network sends appropriate signals to the indicator lamps. The aircraft's position with respect to the glide slope angle and the corresponding operational mode of the indicator lamps are set forth in Table I. The lamp closest to the incoming aircraft is identified as the near lamp or lamp 24, with the lamp farthest from the incoming aircraft identified as the far lamp or lamp 25. The logic network is constructed so as to provide the proper signalling sequence according to Table I.

TABLE I

| AIRCRAFT POSITION | NEAR LAMP (24) | FAR LAMP (25) |
|---|---|---|
| ABOVE GLIDE SLOPE | STEADY | STEADY |
| ON GLIDE SLOPE | FLASHING | STEADY |
| BELOW GLIDE SLOPE | FLASHING | FLASHING |

Operationally, when the aircraft's approach is too low, the pilot sees two flashing lights; when too high, two steady lights; and when within the desired glide slope range, the pilot sees a steady light over a flashing light.

Figure 6:
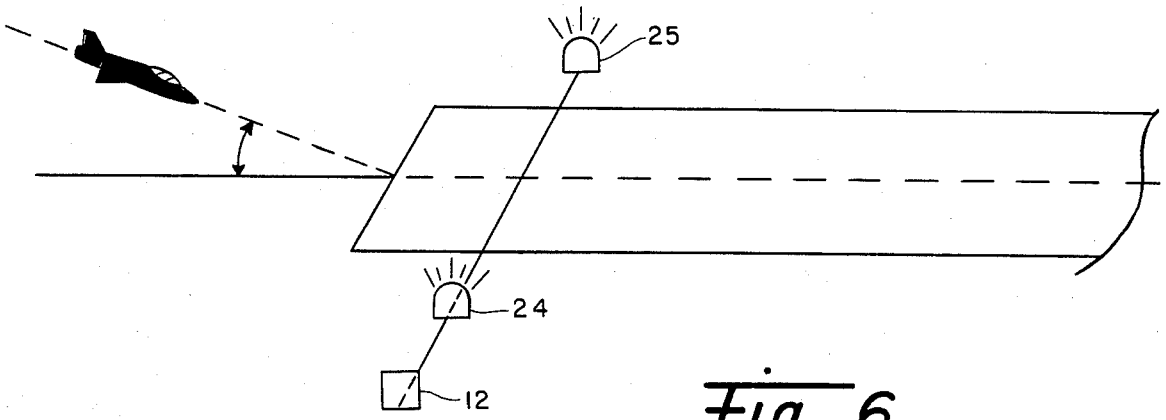
FIG. 6 is a perspective view of an alternate embodiment of the invention showing its operation on an airfield.

An alternate embodiment for the layout of the pilot indicator lamps is shown in FIG. 6. The layout comprises two lamps 24 and 25 placed immediately adjacent to the sides of the runway in the approximate location of the touchdown area. The holding device 12 containing the spherical/cylindrical lens combination and the photodiode array is positioned to the outside of one of the indicator lamps. With this layout, the pilot may be able to more easily discriminate between the two lamps. With either layout embodiment, the lamps are fitted with cones to direct the lamp's illumination only in the longitudinal direction of the runway.

Additional options are also available for use with the present invention. For instance, ground personnel can be notified of the existence of an incoming aircraft and its approach angle by tapping the output signals from the logic network. FIG. 3 shows such an arrangement with a glide slope readout 23 receiving signals from the logic network. This readout is extremely advantageous for both training purposes and research and development purposes. Also, the rate at which the indicator lamps flash can be adjusted, thereby communicating additional information to the pilot. For instance, the photodiode array and logic network could signal when an aircraft is dangerously below the proper glide slope. Thus, if a pilot becomes confused and begins lowering his glide slope after seeing two flashing lamps, the lamps would flash faster thereby signalling the pilot that he has made a wrong maneuver. Another option available is to radio to the pilot the glide slope information. This option could not be accomplished during radio silence operations but it would take advantage of the simplicity and inexpensiveness of the invention.

Thus, while preferred constructional features of the invention are embodied in the structure illustrated herein, it is to be understood that changes and variations may be made by the skilled in the art without departing from the spirit and scope of the invention.

We claim:

1. A visual approach indicator system which utilizes a source of light such as landing lights emitted by an incoming aircraft to guide the aircraft along a desired glide slope to a runway, the source of light having no modulation for use by the indicator system, comprising:

a spherical objective lens of the converging type oriented with its optical axis in the direction of the incoming aircraft;

a cylindrical lens placed adjacent to said spherical objective lens with the height of the cylinder being in the vertical direction and perpendicular to said optical axis such that said spherical/cylindrical lens combination shapes the light from the light source into a line image;

a photodiode array comprising a plurality of photodiodes arranged in a vertical column in which each photodiode is electrically independent from each other, said array being mounted at the back focal plane of said objective lens such that said line image strikes and energizes at least one of the photodiodes in said array, the line image being perpendicular to said vertical column;

logic means connected to said photodiode array such that for each energized photodiode a determination is made as to whether said aircraft's position is above, below, or on said desired glide slope by comparing said line image position with a reference position; and indicator means to communicate to the pilot of said aircraft whether the aircraft is above, below or on said desired glide slope.

2. The indicator system of claim 1, further including an interface/driver means coupled between said logic means and said indicator means for powering said indicator means;

wherein said indicator means includes at least two indicator lamps located on or adjacent to said runway.

3. A visual approach indicator system which utilizes a source of light such as landing lights emitted by an incoming aircraft to guide the aircraft along a desired glide slope to a runway, comprising:

a spherical objective lens of the converging type oriented with its optical axis in the direction of the incoming aircraft;

a cylindrical lens placed adjacent to said spherical objective lens with the height of the cylinder being in the vertical direction and perpendicular to said optical axis such that said spherical/cylindrical lens combination shapes the light from the light source into a line image;

a photodiode array in which each photodiode is electrically independent from each other, said array being mounted at the back focal plane of said objective lens such that said line image strikes and energizes at least one of the photodiodes in said array;

logic means connected to said photodiode array such that for each energized photodiode a determination is made as to whether said aircraft's position is above, below or on said desired glide slope by comparing said line image position with a reference position;

indicator means which includes at least two indicator lamps located on or adjacent to said runway; and an interface/driver means coupled between said logic means and said indicator means for powering said indicator means to cause the lamps to flash, to burn steadily, or a combination of flashing and burning steadily, to communicate to the pilot of said aircraft whether the aircraft is above, below or on said desired glide slope.

4. The indicator system of claim 3, wherein said logic means includes oscillator means for causing said lamps to flash.

5. The indicator system of claim 4, wherein said spherical/cylindrical lens combination is located on or near the runway's touchdown area.

6. The indicator system of claim 5, further including a readout means coupled to said logic means for reading the aircraft's actual glide slope.

* * * * *